US005721556A

United States Patent [19]

Goutzoulis

[11] Patent Number: 5,721,556

[45] Date of Patent: Feb. 24, 1998

[54] FIBEROPTIC MANIFOLD AND TIME DELAY ARRANGEMENT FOR A PHASED ARRAY ANTENNA

[75] Inventor: Akis P. Goutzoulis, Pittsburgh, Pa.

[73] Assignee: Northrop Grumman Corporation, Los Angeles, Calif.

[21] Appl. No.: 748,109

[22] Filed: Nov. 8, 1996

[51] Int. Cl.[6] ..... H01Q 3/22

[52] U.S. Cl. ..... 342/375; 342/374

[58] Field of Search ..... 342/375, 372, 342/81, 374

[56] References Cited

U.S. PATENT DOCUMENTS 4,216,474 8/1980 Levine ..... 343/17.2 PC
4,258,363 3/1981 Bodmer et al. ..... 343/16 R
4,725,844 2/1988 Goodwin et al. ..... 342/374
5,231,405 7/1993 Riza ..... 342/375
5,305,009 4/1994 Goutzoulis et al. ..... 342/157
5,325,102 6/1994 Page ..... 342/375

*Primary Examiner*—Thomas H. Tarcza
*Assistant Examiner*—Dao L. Phan
*Attorney, Agent, or Firm*—Walter G. Sutcliff

[57] ABSTRACT

A time delay and manifold arrangement for ,a phased array antenna. A predetermined delay is imparted to an rf signal to be transmitted by a combination of an electronic delay line, at an electronics site, which imparts a relative small delay, and a passive fiberoptic delay line, at an antenna site, which imparts a much longer delay. An rf signal is delayed and converted to an optical signal at the electronics site and is conveyed to the antenna site by means of an optical fiber. The arrangement is applicable to a receive mode of operation wherein the optical delay is imparted first at the antenna site, followed by electronic delay at the electronics site.

7 Claims, 6 Drawing Sheets

FIBEROPTIC MANIFOLD AND TIME DELAY ARRANGEMENT FOR A PHASED ARRAY ANTENNA

BACKGROUND OF THE INVENTION

1. Field of the Invention

The invention in general relates to antenna systems and more particularly to an improved architecture for signal delay in a phased array antenna.

2. Description of Related Art

A phased array antenna is comprised of a plurality of individual antenna elements each of which may be capable of transmitting and receiving radio frequency (rf) signals. By properly phasing the antenna elements, one or more antenna beams may be formed at various angles without the requirement of physically rotating the antenna.

The relative phasing applied to the antenna elements may be accomplished by means of time delay circuitry such as binary electronic delay lines wherein, by application of proper control signals, the rf signal to be delayed may be selectively routed through increasing lengths of delay line, the lengths of which increase successively by powers of 2. If relatively long delays are required, such electronic delay lines can be extremely lossy and can add distortion to the signal, particularly at the higher rf frequencies, and accordingly their use should be limited to relatively small delays.

Another type of delay circuitry that is commonly used is the fiberoptic delay line, one example of which is known as a bifodel (binary fiberoptic delay line). Such fiberoptic delay lines can impart significantly longer delays than an electronic delay line, however the optical switches required to select desired delay times contribute to high signal losses. In addition, these bifodels are economically unattractive.

One known arrangement such as illustrated in U.S. Pat. No. 5,305,009, can transmit several different wavelengths and uses both electronic delays as well as bifodels. In addition to the losses associated with the bifodels, the arrangement requires optical multiplexers as well as optical demultiplexers, resulting in an extremely lossy system.

The present invention provides a relatively inexpensive and low loss fiberoptic manifold for signal distribution and broadband delay steering for a phased array antenna.

SUMMARY OF THE INVENTION

A fiberoptic manifold and time delay arrangement for a phased array antenna is provided and includes a source of rf signal to be transmitted. An electronic delay line imparts a first predetermined delay, $d_1$, to the rf signal. An optical signal source connected to the electronic delay line converts the rf signal to an optical signal and transmits it along an optical fiber which extends from an electronics site to an antenna site. A completely passive fiberoptic delay line arrangement is operable to receive the optical signal transmitted along the optical fiber and to impart selective delays thereto including a second predetermined delay, $d_2$, to the signal, where $d_2>d_1$. Detector circuitry is provided for converting the delayed optical signals back to respective rf signals and a switch means is operable to select the converted signal having the desired delay and applying it to at least one antenna element of the phased array antenna. A similar arrangement may be used in a receive mode wherein the optical delay is applied first, followed by the electronic delay.

BRIEF DESCRIPTION OF THE DRAWINGS

Similar reference characters refer to similar parts throughout the several FIGS.

DESCRIPTION OF THE PREFERRED EMBODIMENTS

Figure 1:
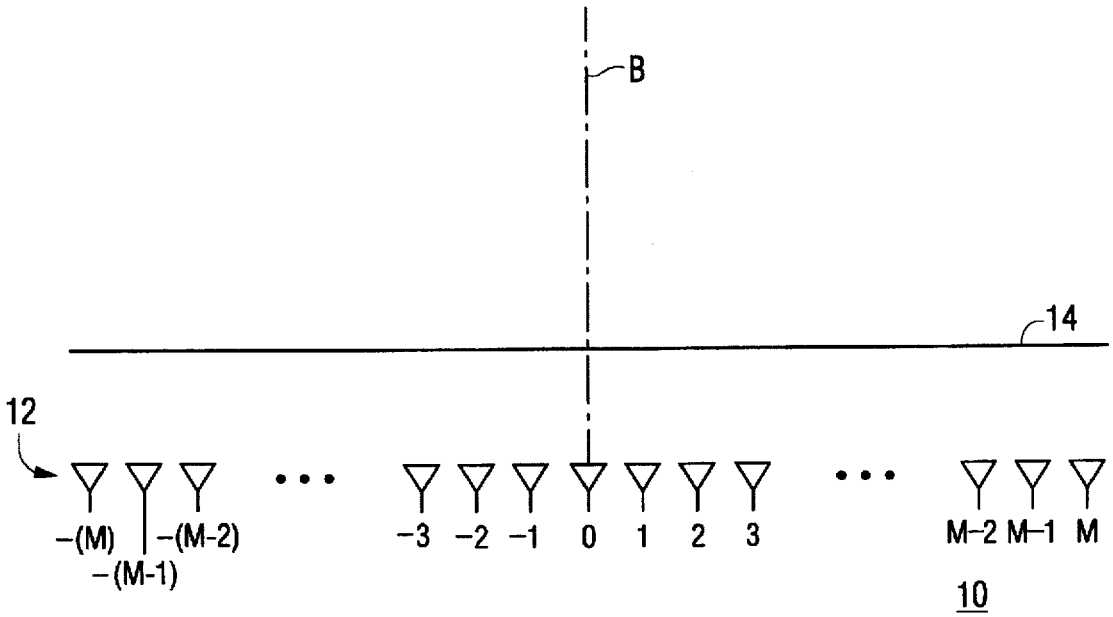
FIGS. 1 and 2 show a plurality of antenna elements to illustrate beam direction.

FIG. 1 illustrates a phased array antenna 10 having a plurality of antenna elements 12 which may typically be dipoles, slots, open ended waveguides, or printed circuit patches, by way of example. For simplicity, a line array is illustrated, although the principles equally apply to a two dimensional array. Numeral 14 represents a uniphase front of an incoming signal and it is seen that the phase front will impinge upon all of the antenna elements, +M to −M, at the same time and a receiver beam will be formed looking perpendicular to the array along the boresite B.

Figure 2:
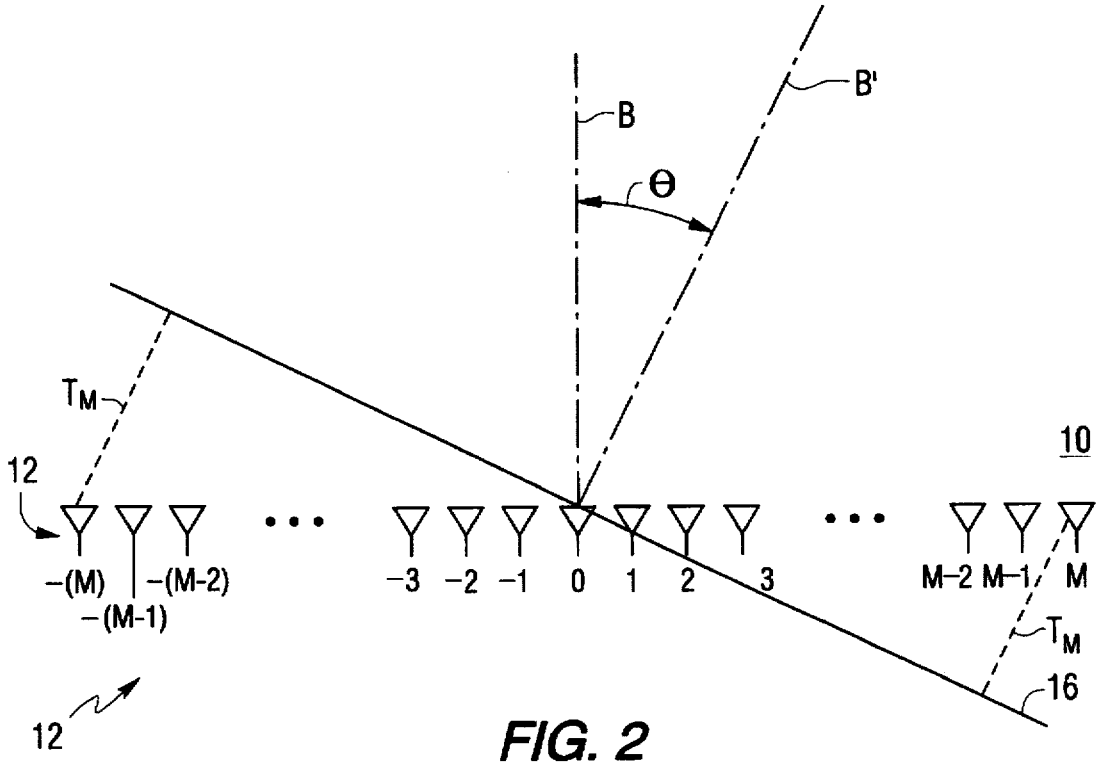

If various signal delays are applied to the respective antenna elements +M to −M, a beam may be formed which is pointed in another direction. For example, in FIG. 2 a uniphase front 16 is illustrated as exciting the center antenna element 0. By applying appropriate progressive delays to the remaining elements a beam may be formed which points at an angle θ, along line B', relative to the boresite. Maximum delays $\pm T_M$ are applied to the outer elements and the delays progressively decrease as the center element is approached.

The principles applicable to the receive case are equally applicable to the transmit mode of operation by delaying the rf signals which are to be applied to the antenna elements. In addition, by providing multiple delays for each antenna element, or groups of elements, multiple simultaneous beams may be formed.

In the present invention the longer delays required by the outer antenna elements are provided by a combination of electronic delay circuitry in conjunction with passive fiberoptic delay lines. The shorter delays, such as near the center antenna elements, may be accommodated solely by electronic delay means.

Figure 3:
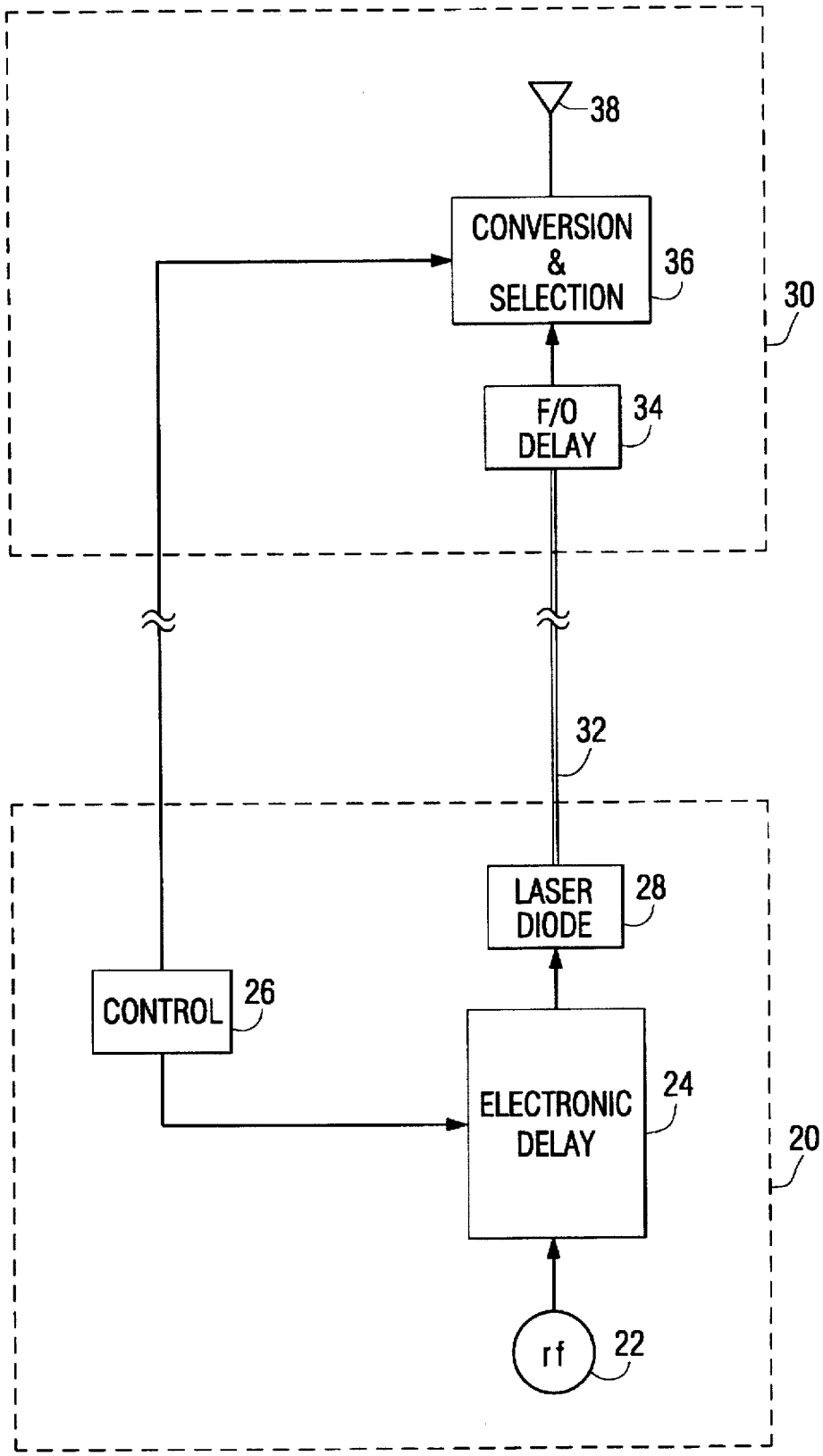
FIG. 3 is a block diagram of a transmitter arrangement in accordance with one aspect of the present invention.

FIG. 3 illustrates an embodiment of the present invention used for transmission only of rf energy. Located at an electronics site 20 is a source 22 of rf signal to be transmitted. The rf signal is delayed by a predetermined amount $d_1$ by electronic means such as electronic delay 24, with the amount of delay being selected by control circuitry 26. The delayed electronic signal is converted to an optical signal by means of, for example, a laser diode and applied to a signal distributor in the form of optical fiber 32 acting as a manifold for conveying the optical signal to an antenna site 30.

At the antenna site a second predetermined delay $d_2$ is imparted to the signal by means of a passive optical delay line arrangement 34, where the optical delay is much longer than the electronic delay provided by circuit Conversion back to an electronic signal is accomplished by an optical to electrical conversion and selection circuit 36 which applies the desired converted signal to at least one antenna element 38. Similar arrangements will be provided for remaining antenna elements which require delays in excess of that which can be provided solely by electronic delays.

Figure 4:
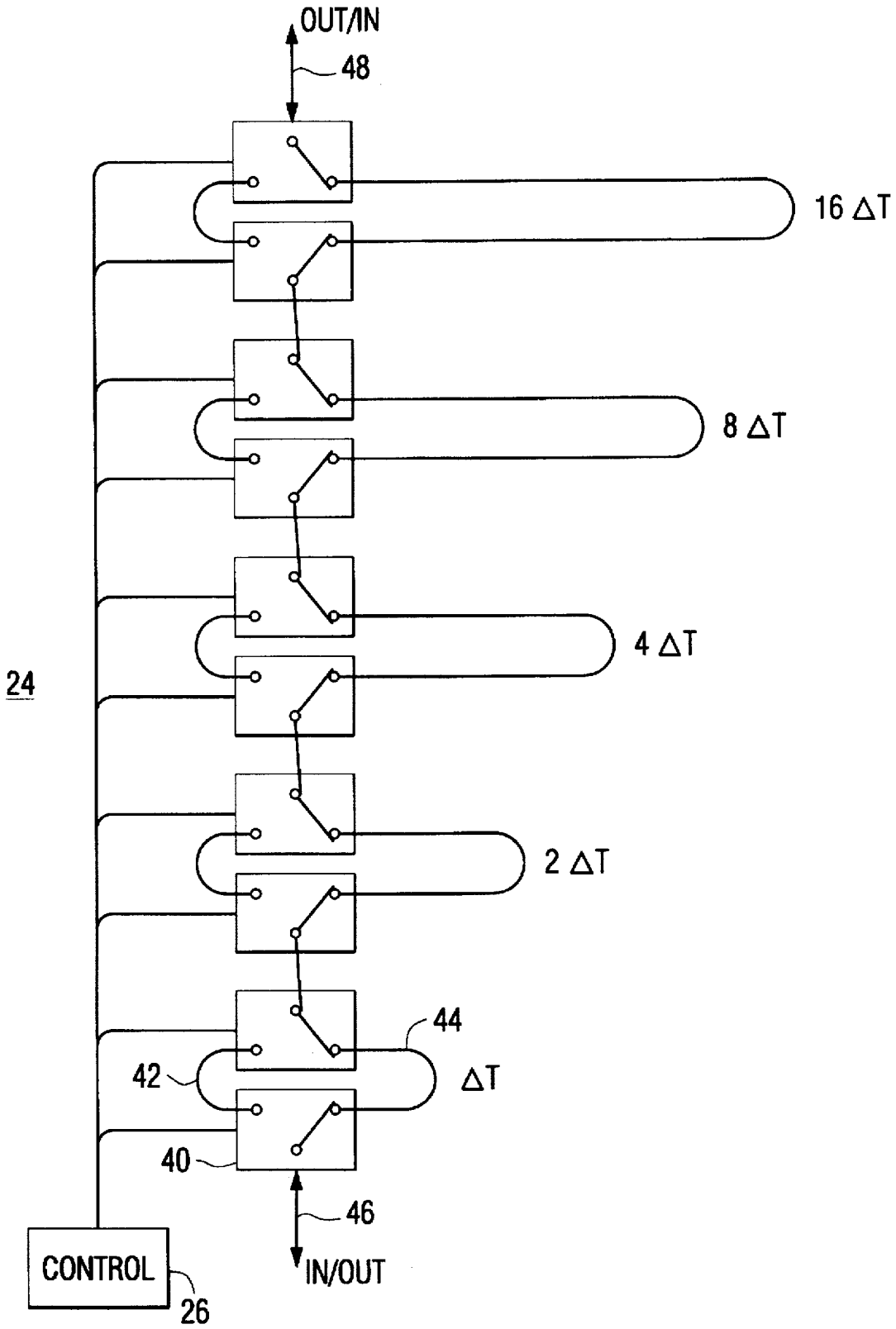
FIG. 4 is a more detailed presentation of the electronic delay of FIG. 3.

FIG. 4 illustrates a well-known type of electronic delay which may be used herein. The delay line 24 is a five bit delay line and utilizes two back-to-back switches 40, such as GaAS FET switches to implement a 2×2 switch. The arrangement allows signal flow in either direction through a series of lines 42 of equal length or a set of lines 44 of progressively greater length. Lines 44 are generally sized so as to provide a delay AT that doubles as the signal travels across consecutive switches 40, the path being selected by control circuit 26. With five sets of switches the delay is a five bit delay and will allow 32 different delay combinations. An input signal may be applied to the electronic delay 24 at port 46 and the delayed signal may be extracted at port 48. Conversely, port 48 may act as an input port, in which case port 46 would be the output port.

Figure 5:
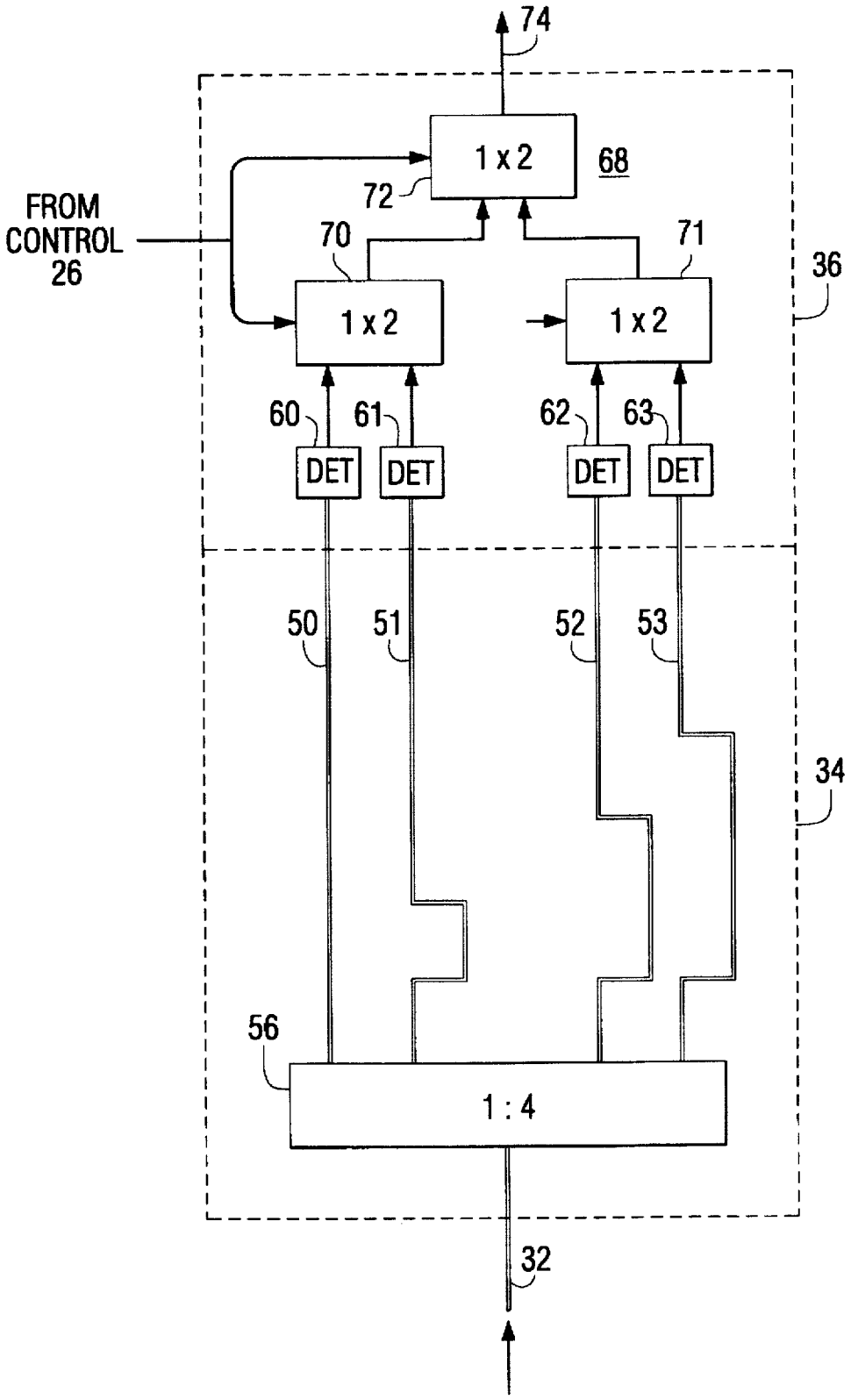
FIG. 5 is a more detailed presentation of the fiberoptic delay of FIG. 4.

An electronic delay such as illustrated in FIG. 4 may be used for picosecond delays and up to, for example, 2.5 ns (nanoseconds) without significant degradation of the signal. For longer delays such as may be required by the outer antenna elements the electronic delay is augmented by the fiberoptic delay line 34, one example of which is illustrated in FIG. 5.

The fiberoptic delay line arrangement 34 is an example of a 2 bit delay line allowing 4 (i.e., $2^2$=4) different delay times. The delay line includes four optical fibers, 50–53, of progressively increasing length corresponding to increasing delays which will be imparted to the optical signal conveyed on optical fiber 32. In the general case n optical fibers will be provided. The optical signal is provided to all of the fibers 50–53 by means of a 1:n optical signal divider 56 which is completely passive and requires no control or switching components. In the illustrated case n=4. Such dividers are commercially available and may be formed of fused optical fibers. As an alternative, a tapped serial optical delay line may be utilized.

Each of the optical fibers 50–53 conveys the same signal with the difference being the amount of delay imparted by the particular optical fiber. The desired delayed signal is selected for presentation to an antenna element by means of conversion and selection circuitry 36 which includes a plurality of detectors 60–63, each for converting a respective one of the optical signals conveyed by optical fibers 50–53 into corresponding electrical signals.

The conversion and selection circuitry 36 additionally includes switching means for selecting one of the four outputs from detectors 60–63. This may be accomplished by means of a single pole-four-throw switch, or, as illustrated, by means of a tree type 1×4 FET switch 68 constituted by three 1×2 FET switches 70–72 similar to those of the electronic delay line described in FIG. 4, and all being formatted in response to a signal from control circuit 26. The selected signal, which has been given the desired delay is then provided to one or more antenna elements via line 74.

Figure 6:
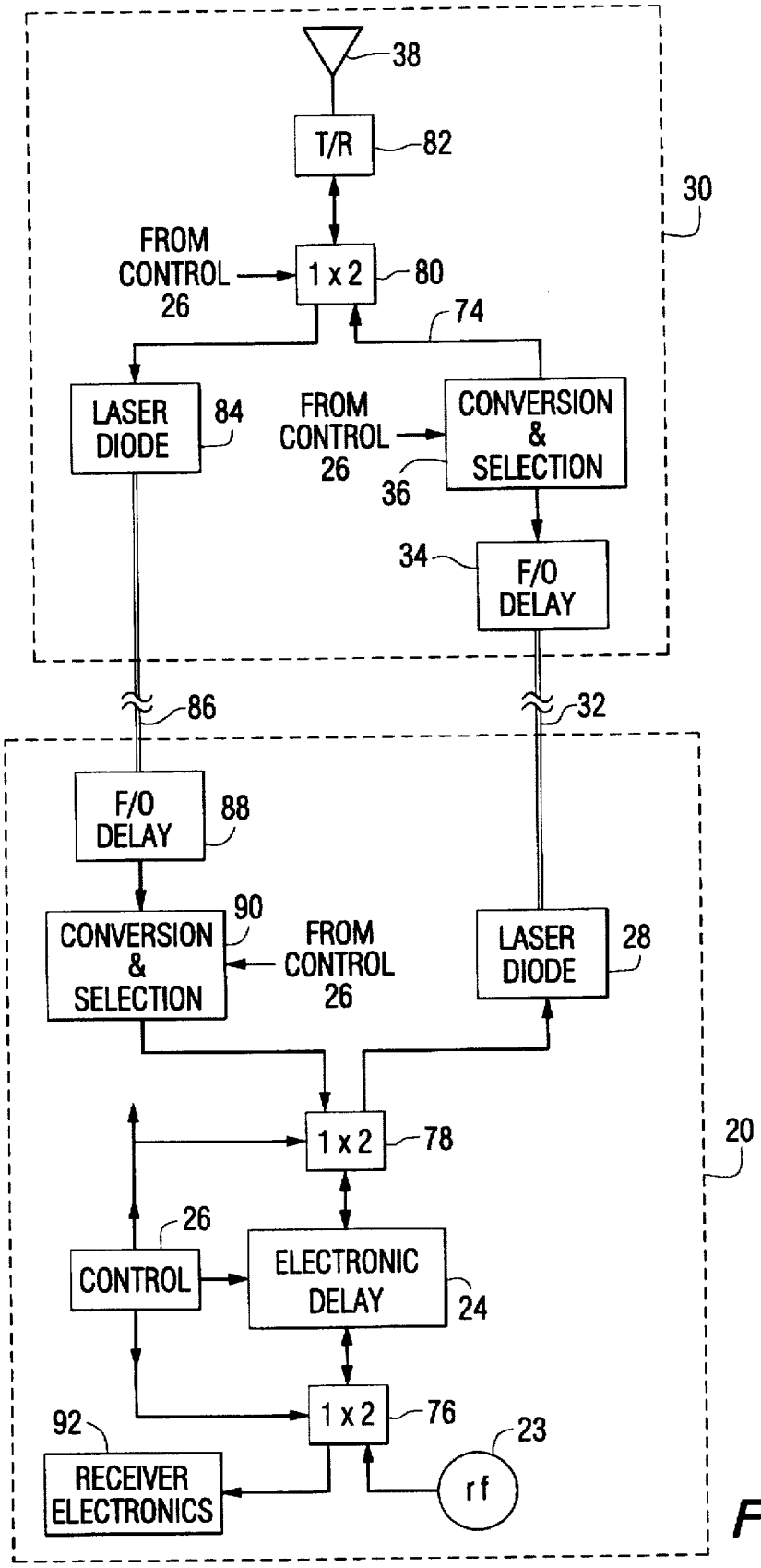
FIG. 6 illustrates another embodiment of the present invention for both transmission and reception of signals.

The architecture of the apparatus described in FIG. 3 may be modified for applications which require both transmit and receive functions and FIG. 6 illustrates one such modification. The transmit circuitry of FIG. 6 is similar to that of FIG. 3 but additionally includes at the electronics site 20, a 1×2 FET switch 76 which will direct the rf signal from source 22 to the electronic delay 24 and a 1×2 FET switch 78 for directing the electronically delayed signal to the laser diode 28.

The antenna site 30 additionally includes a 1×2 FET switch 80 whereby the signal on line 74 may be presented to the antenna element 38 via a T/R (transmit/receive) module 82. An incoming signal received by the antenna element 38 is directed by means of T/R module 82 and 1×2 switch 80 to a laser diode 84 which is operable to transmit a corresponding optical signal back to the electronics site 20 by way of a manifold constituted by optical fiber 86. The received signal is delayed by means of passive fiber optic delay arrangement 88 similar to that described in FIG. 5, and the desired delayed signal, having a desired delay of $d_3$ is selected by the optical to electrical conversion and selection circuit 90, also similar to that described in FIG. 5. The selected signal is then passed through the 1×2 switch 78 and is given a predetermined electrical delay in electronic delay 24, which, it is seen, functions to provide the necessary small signal delays in both the transmit mode as well as the receive mode. The delayed signal from the electronic delay 24 is then passed through the 1×2 FET switch 76 to the receiver electronics 92 for processing.

With the arrangement illustrated in FIG. 6 the two laser diodes 28 and 84 do not have to be of the same quality. For the receive operation a high quality laser diode, such as is utilized in the cable TV field should be used. However, the laser diode used for transmission can be of a lower quality, such as used in compact CD players. The difference in quality is due to the fact that in the transmission mode the signal-to-noise ratio and spurious-free dynamic range requirements are significantly lower than those for the receive mode and can be satisfied with low cost laser diodes.

The advantages of utilizing fiberoptic technology for phased array antennas are well known. In addition to its small size, light weight and flexibility, a fiberoptic system has extremely low loss and dispersion which allows for antenna remoting. By virtue of the small ratio of rf signal bandwidth to optical frequency, the fiberoptic arrangement has excellent transmission stability. It is a nonconductive dielectric and does not disturb the rf field and is secure from rf crosstalk and electromagnetic interference.

The above advantages apply to the present invention wherein the sum of the electronic delay and fiberoptic delay form a multibit programmable delay wherein the lower least significant bits of delay are implemented electronically and the first most significant bits of delay are implemented by completely passive optical delay means. Expensive and lossy optical switching components are eliminated. High speed delay switching is accomplished by low loss electronic switches which are one or two orders of magnitude less expensive than higher loss optical switches.

Figure 7:
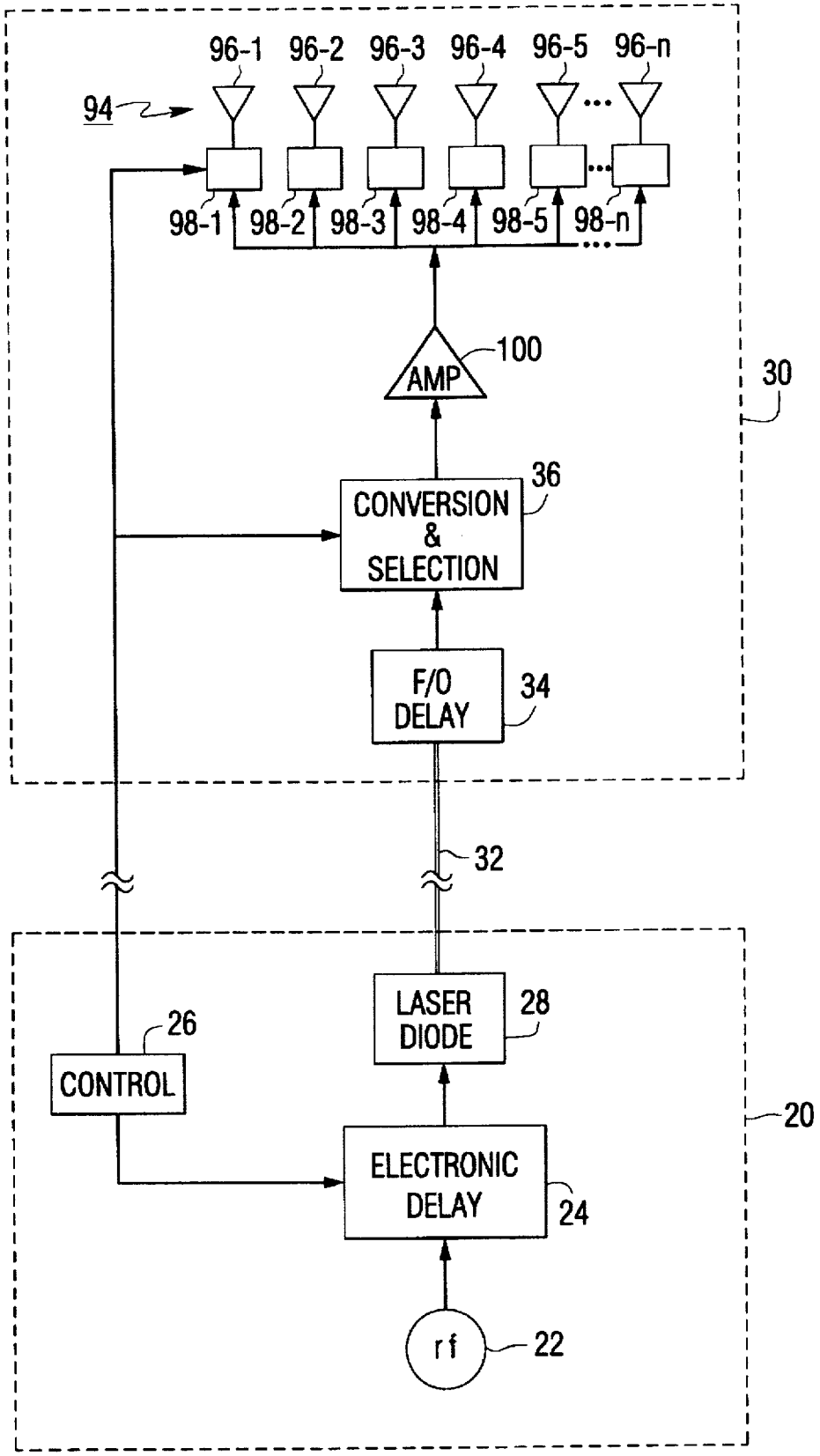
FIG. 7 is a view as in FIG. 1 illustrating application of a signal to a subarray.

In the embodiments thus far described, an rf signal is manifolded to or from a single antenna element. FIG. 7, which duplicates the apparatus of FIG. 3, illustrates an embodiment wherein the rf signal is provided to a subarray 94 comprised of a plurality of antenna elements 96-1 to 96-n, each of which may be provided with an individual delay circuit 98-1 to 98-n. The signal from the optical to electronic conversion and selection circuit 36 is suitably amplified in amplifier 100 prior to being provided to the subarray 94. Although a transmission arrangement is shown by way of example, the subarray could also be utilized in a transmit/receive arrangement such as illustrated in FIG. 6.

What is claimed is:

1. Fiberoptic manifold and time delay apparatus for a phased array antenna having a plurality of antenna elements, comprising:

(a) a source of rf signal to be transmitted;

(b) an electronic delay line for imparting a first predetermined delay, $d_1$, to said rf signal;

(c) an optical fiber;

(d) an optical signal source connected to said electronic delay line for converting said rf signal to an optical signal and transmitting it along said optical fiber;

(e) a completely passive fiber optic delay line arrangement operable to receive the optical signal transmitted along said optical fiber and impart selective delays thereto, including a second predetermined delay, $d_2$, where $d_2>d_1$;

(f) detector means for converting said optical signals back to respective rf signals; and (g) switch means for selecting the converted signal having said predetermined delay $d_2$, and applying same to at least one of said antenna elements.

2. Apparatus according to claim 1 wherein:

(a) said fiberoptic delay line arrangement includes a 1:n optical divider having an input and n outputs;

(b) said fiberoptic delay line arrangement additionally includes n optical fibers of progressively greater length;

(c) said optical fiber which conveys the optical signal from said optical signal source being connected to said input of said optical divider;

(d) said n optical fibers being connected to a respective one of said n outputs of said optical divider.

3. Apparatus according to claim 1 wherein:

(a) said detector means includes n detectors each connected to a respective one of said n optical fibers for providing an electrical output signal in response to the optical signal received.

4. Apparatus according to claim 1 which includes:

(a) a second optical signal source for converting an input rf signal to an optical signal;

(b) a transmit/receive module and switch connected to said antenna element and operable to direct a received rf signal at said antenna element to said second optical signal source;

(c) a second optical fiber for conveying the signal provided by said second optical signal source;

(d) a second completely passive fiberoptic delay line arrangement operable to receive the optical signal conveyed by said second optical fiber and impart selective delays thereto including a predetermined delay, $d_3$;

(e) additional detector circuitry for converting said delayed optical signals of said second fiberoptic delay line arrangement back to respective rf signals;

(f) additional switching means for selecting the converted signal having the predetermined delay, $d_3$, and applying same to said electronic delay line;

(g) a receiver for processing rf signals; and (h) switch means for applying the received signal delayed by said electronic delay line to said receiver.

5. Apparatus according to claim 4 which includes:

(a) a plurality of antenna elements constituting a subarray;

(b) said switch means is operable to apply said selected converted signal to all of the antenna elements of said subarray.

6. Apparatus according to claim 5 wherein:

(a) said transmit/receive module and switch being connected to said subarray.

7. A fiberoptic manifold and time delay for a phased array antenna having a plurality of antenna elements, comprising:

(a) an electronic site;

(b) an antenna site;

(c) an electronic delay at said electronic site for receiving and delivering an rf signal to be transmitted;

(d) an optical signal source at said electronic site operable to convert said signal delayed by said electronic delay, to a corresponding optical signal;

(e) a completely passive fiberoptic delay line arrangement, at said antenna site, operable to apply a plurality of delays to an input signal;

(f) a single optical fiber extending from said electronic site to said antenna site for applying said optical signal to said passive fiberoptic delay line arrangement; and (g) means, at said antenna site, for converting said delayed optical signals to corresponding rf signals and selecting one of them for presentation to at least one of said antenna elements.

* * * * *